United States Patent [19]

de Vos

[11] 3,965,451

[45] June 22, 1976

[54] BALLAST TRANSFORMER MOUNTING ARRANGEMENT

[75] Inventor: Hendrik A. J. de Vos, Swansea, Mass.

[73] Assignee: GTE Sylvania Incorporated, Stamford, Conn.

[22] Filed: May 1, 1975

[21] Appl. No.: 573,434

[52] U.S. Cl. ..... 336/67; 336/68; 403/154

[51] Int. Cl.[2] ..... H01F 15/02

[58] Field of Search ..... 336/65, 66, 67, 68, 336/210; 85/8.3, 5 M, 5 N, 8.1; 403/154, 155, 318, 316, 292

[56] References Cited

UNITED STATES PATENTS

| | | | |
|---|---|---|---|
| 824,526 | 6/1906 | Coffin | 85/5 N |
| 1,611,942 | 12/1926 | Persons | 336/210 X |
| 1,997,550 | 4/1935 | O'Leary | 336/210 |
| 2,796,590 | 6/1957 | Barnett | 336/65 X |
| 2,835,875 | 5/1958 | Bistany | 336/65 X |
| 2,879,489 | 3/1959 | Mitchell | 336/210 X |
| 3,227,030 | 1/1966 | Preziosi et al. | 85/8.3 X |

FOREIGN PATENTS OR APPLICATIONS

| | | | |
|---|---|---|---|
| 1,409,699 | 7/1965 | France | 336/65 |

*Primary Examiner*—Thomas J. Kozma
*Attorney, Agent, or Firm*—Peter Xiarhos; Elmer J. Nealon; Norman J. O'Malley

[57] ABSTRACT

A mounting arrangement for mounting a ballast transformer to a structural support member. As employed in accordance with the invention, the ballast transformer has an opening through the core portion thereof. A pair of L-shaped mounting members are mounted to the ballast transformer by means of a pair of elongated, compressible mounting pins, commonly known as "rollpins," which are driven through openings in the vertical portions of the L-shaped mounting members into opposite entrances of the opening in the ballast transformer. The mounting members are then secured to the structural support member by means of threaded fasteners which are inserted through openings in the structural support member and threaded into openings in the horizontal portions of the L-shaped mounting members. The threaded fasteners are selected to have lengths so that the threaded portions thereof will extend past the exposed ends of the mounting pins and be immediately adjacent thereto. As a result, the pins are locked positively in place and are prevented from being removed accidentally from the opening in the core portion of the ballast transformer and the openings in the vertical portions of the L-shaped mounting members.

7 Claims, 2 Drawing Figures

BALLAST TRANSFORMER MOUNTING ARRANGEMENT

BACKGROUND OF THE INVENTION

The present invention relates to a mounting arrangement and, more particularly, to a mounting arrangement for quickly and easily mounting a ballast transformer to a structural support member such as employed in an electrical lighting fixture.

In the manufacture of electrical lighting fixtures, particularly lighting fixtures utilizing high intensity discharge (HID) lamps, it is generally required to provide ballast transformers for properly controlling the operation of these lamps. In order to minimize assembly time and, therefore, reduce manufacturing costs, it is desirable that the ballast transformers employed by the lighting fixtures be quickly and easily mounted within the lighting fixtures, especially where the ballast transformers are bulky, heavy, and awkward to handle, and are required to be mounted in compartments of very limited space. The present invention is directed to a mounting arrangement of very simple design for quickly and easily mounting a ballast transformer to a structural support member, for example, as employed in a lighting fixture.

BRIEF SUMMARY OF THE INVENTION

A ballast transformer to be mounted to a structural support member in accordance with the present invention includes a core portion made up of several laminations and has an opening in the core portion with first and second entrances. A mounting arrangement for mounting the ballast transformer to the structural support member in accordance with the invention comprises first and second mounting members and first and second securing means. The first mounting member has a first elongated, non-threaded mounting pin associated therewith which is inserted, via the first entrance, into the opening in the core portion of the ballast transformer. In a similar fashion, the second mounting member has a second elongated, non-threaded mounting pin associated therewith which is inserted, via the second entrance, into the opening in the core portion of the ballast transformer. The first securing means secures the first mounting member to the structural support member and the second securing means secures the second mounting member to the structural support member.

BRIEF DESCRIPTION OF THE DRAWING

Various objects, features and advantages of a ballast transformer mounting arrangement in accordance with the present invention will be apparent from the following detailed description taken in conjunction with the accompanying drawing in which.

DETAILED DESCRIPTION OF THE INVENTION

Figure 1:
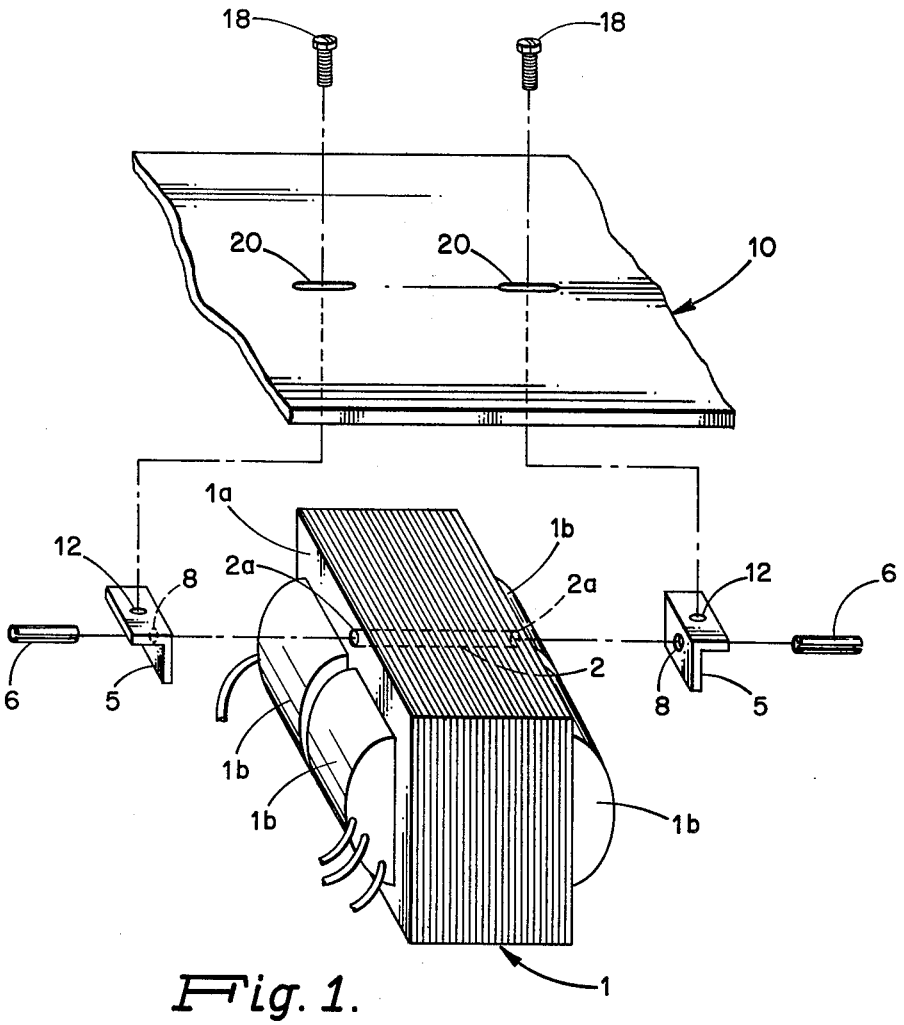
FIG. 1 is an exploded view illustrating the manner in which a ballast transformer is mounted to a structural support member in accordance with the present invention.

Referring now to FIG. 1, there is shown a ballast transformer 1 as arranged to be mounted to a structural support member 10 in accordance with the present invention. The ballast transformer 1 is of a conventional design and includes, as shown in FIG. 1, a core section 1*a* formed by the lamination of a large number of thin metal plates, and a plurality of winding sections 1*b*. As employed in accordance with the present invention, the ballast transformer 1 has an opening 2 extending through the laminated core section 1*a* thereof and having opposed first and second entrances 2*a*. The opening 2 is used in conjunction with a pair of L-shaped brackets 5 for the purpose of mounting the ballast transformer 1 to the structural support member 10. More particularly, and as indicated in FIG. 1, the L-shaped brackets 5 are mounted to the ballast transformer 1 by means of a pair of non-threaded elongated, compressible, split hollow mounting pins 6, commonly known as "roll-pins," which are first force-inserted through unthreaded openings 8 in the vertical portions of the L-shaped brackets 5 and then inserted into the opposing entrances 2*a* of the opening 2 in the ballast transformer 1. The diameters of the openings 8 and of the split mounting pins 6 are selected so that the mounting pins 6 will become compressed when force-inserted into the openings 8 and then tend to expand slightly once in the openings 8 to provide tight fits therein. It is not necessary for the pins 6 to fit tightly within the opening 2 in the ballast transformer 1, however, the lengths of the portions of the pins 6 within the opening 2 in the ballast transformer 1 should be sufficient to prevent the L-shaped brackets 5 from falling away from the ballast transformer 1. In addition, and for reasons to be apparent shortly, the lengths of the pins 6 should not be so great that the pins 6 lie in the paths of threaded openings 12 provided in the horizontal portions of the L-shaped brackets 5.

Figure 2:
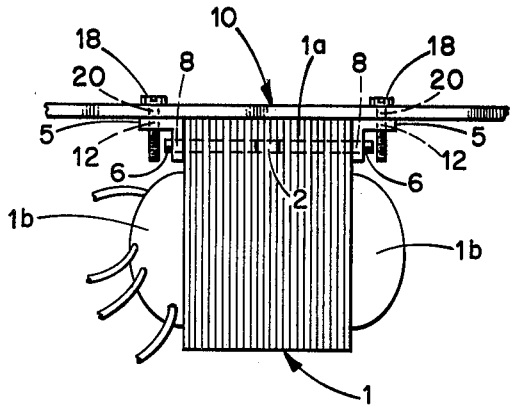
FIG. 2 is a front view illustrating the ballast transformer as mounted to the structural support member.

Once the L-shaped brackets 5 have been mounted to the ballast transformer 1 as described hereinabove, a pair of threaded bolts 18 are inserted into slotted openings 20 in the structural support member 10 and, after the ballast transformer 1 and the L-shaped brackets 5 have been properly positioned with respect to the structural support member 10, the bolts 18 are threaded into the openings 12 in the horizontal portions of the L-shaped brackets 5. The threaded bolts 18 are selected to have lengths so that the threaded portions thereof will extend past the axes of the mounting pins 6 and be immediately adjacent to the exposed ends of the mounting pins 6, as indicated in FIG. 2. As a result, the mounting pins 6 are "locked" positively in place by the threaded bolts 18 and are prevented from being removed accidentally, for example, as a result of vibration, from the associated openings 2 and 8.

It will now be apparent that a mounting arrangement has been described hereinabove which comprises very few parts and which is very simple to use. Thus, the ballast transformer 1 as described hereinabove may be easily and quickly mounted to a structural support member, even if the ballast transformer is heavy, bulky and awkward to handle and the ballast transformer is required to be installed in a compartment of limited space.

While there has been described what is considered a preferred embodiment of the invention, it will be obvious that various changes and modifications may be made therein without departing from the invention as called for in the appended claims.

What is claimed is:

1. A mounting arrangement mounting a ballast transformer to a structural support member, said ballast transformer including a core portion made up of several laminations and having an opening in said core portion with first and second entrances, said mounting arrangement comprising:

a first mounting member having a first elongated, non-threaded mounting pin associated therewith and inserted, via the first entrance, into the opening in the core portion of the ballast transformer;

a second mounting member having a second elongated, nonthreaded mounting pin associated therewith and inserted, via the second entrance, into the opening in the core portion of the ballast transformer;

first securing means securing the first mounting member to the structural support member; and second securing means securing the second mounting member to the structural support member.

2. A mounting arrangement in accordance with claim 1 wherein:

the structural support member has a surface adjacent to the ballast transformer; and each of the first and second mounting members has a portion abutting the aforesaid surface of the structural support member.

3. A mounting arrangement mounting a ballast transformer to a structural support member, said ballast transformer including a core portion made up of several laminations and having an opening in said core portion with first and second entrances, said mounting arrangement comprising:

a first mounting member having a first portion with an opening therein and a second portion extending from the first portion;

a first elongated mounting pin extending through the opening in the first portion of the first mounting member and inserted, via the first entrance, into the opening in the core portion of the ballast transformer;

a second mounting having a first portion with an opening therein and a second portion extending from the first portion;

a second elongated mounting pin extending through the opening in the first portion of the second mounting member and inserted, via the second entrance, into the opening in the core portion of the ballast transformer;

first securing means securing the second portion of the first mounting member to the structural support member and having a portion crossing the axis of the first mounting pin and immediately adjacent to the exposed end of the first mounting pin, thereby to effectively lock the first mounting pin in position and prevent its removal from the opening in the core portion of the ballast transformer; and second securing means securing the second portion of the second mounting member to the structural support member and having a portion crossing the axis of the second mounting pin and immediately adjacent to the exposed end of the second mounting pin, thereby to effectively lock the second mounting pin in position and prevent its removal from the opening in the core portion of the ballast transformer.

4. A mounting arrangement in accordance with claim 3 wherein:

the first and second mounting members are L-shaped members, the first and second portions of the first and second mounting members corresponding to the vertical and horizontal portions of the L-shaped members, respectively.

5. A mounting arrangement in accordance with claim 4 wherein:

the first elongated mounting pin is an elongated compressible, split, hollow tube member tightly disposed within the opening in the vertical portion of the first L-shaped mounting member and disposed in the opening in the core portion of the ballast transformer; and the second elongated mounting pin is an elongated, compressible, split, hollow tube member tightly disposed within the opening in the vertical portion of the second L-shaped mounting member and disposed in the opening in the core portion of the ballast transformer.

6. A mounting arrangement in accordance with claim 4 wherein: the structural support member has first and second openings therein;

the horizontal portion of each of the first and second L-shaped mounting member has a threaded opening therein;

the first securing means includes a threaded fastener inserted into the first opening in the structural support member and threaded into the threaded opening in the horizontal portion of the first L-shaped mounting member, the threaded portion of the threaded fastener crossing the axis of the first mounting pin and being disposed immediately adjacent to the exposed end of the first mounting pin thereby to effectively lock the first mounting pin in position; and the second securing means includes a threaded fastener inserted into the second opening in the structural support member and threaded into the threaded opening in the horizontal portion of the second L-shaped mounting member, the threaded portion of the threaded fastener crossing the axis of the second mounting pin and being disposed immediately adjacent to the exposed end of the second mounting pin thereby to effectively lock the second mounting pin in position.

7. A mounting arrangement in accordance with claim 6 wherein:

the first elongated mounting pin is an elongated compressible, split hollow tube member tightly disposed within the opening in the vertical portion of the first L-shaped mounting member and disposed in the opening in the core portion of the ballast transformer; and the second elongated mounting pin is an elongated, compressible, split, hollow tube member tightly disposed within the opening in the vertical portion of the second L-shaped mounting member and disposed in the openings in the core portion of the ballast transformer.

* * * * *